US012686532B2

(12) United States Patent
Liu

(10) Patent No.: US 12,686,532 B2
(45) Date of Patent: Jul. 21, 2026

(54) STORAGE BOX FOR ASSEMBLED TOYS

(71) Applicant: Haian Liu, Heping (CN)

(72) Inventor: Haian Liu, Heping (CN)

( * ) Notice: Subject to any disclaimer, the term of this patent is extended or adjusted under 35 U.S.C. 154(b) by 0 days.

(21) Appl. No.: 19/401,765

(22) Filed: Nov. 26, 2025

(65) Prior Publication Data

US 2026/0077908 A1 Mar. 19, 2026

(30) Foreign Application Priority Data

Nov. 14, 2025 (CN) ..... 202522418002.9

(51) Int. Cl.
*B65D 25/10* (2006.01)
*B65D 1/34* (2006.01)
*B65D 21/02* (2006.01)

(52) U.S. Cl.
CPC ..... *B65D 25/108* (2013.01); *B65D 1/34* (2013.01); *B65D 21/0213* (2013.01)

(58) Field of Classification Search
CPC .... B65D 25/108; B65D 1/34; B65D 21/0213; A63H 3/52
USPC ..... 206/315.1, 1.5, 6.1, 752, 756, 765, 775, 206/736, 764, 579, 471, 477; 446/75, 86, 446/106, 73, 515
See application file for complete search history.

(56) References Cited

U.S. PATENT DOCUMENTS 3,837,653 A * 9/1974 Fox ..... A63F 7/0628 473/185
5,116,240 A * 5/1992 Wischhusen ..... B65D 81/3834 206/499
7,802,677 B2 * 9/2010 Williams ..... B65D 83/0463 206/538
8,096,411 B2 * 1/2012 Bailey ..... B65D 83/0409 206/468
2010/0126886 A1 * 5/2010 Le ..... B65D 83/0463 206/1.5
2015/0321811 A1 11/2015 Yeung
2021/0139186 A1 5/2021 Kobayashi et al.
2025/0031845 A1 1/2025 Li

* cited by examiner

*Primary Examiner* — Rafael A Ortiz
(74) *Attorney, Agent, or Firm* — Hemisphere Law, PLLC

(57) ABSTRACT

A storage box for assembled toys includes a housing, a box cover covering the housing, and a supporting structure. The housing defines a first accommodating groove for accommodating assembled toys. The box cover includes a first plate and a first side plate provided on the first plate. The first side plate defines a limiting slot for avoiding the box for assembled toys. The supporting structure is provided on the first plate and is spaced apart from the first side plate. The supporting structure is provided with a supporting portion inclined to the horizontal plane. The supporting portion is arranged opposite to the limiting slot. The supporting portion is configured for abutting against a side wall of the box for assembled toys so that the box for assembled toys is obliquely placed.

18 Claims, 11 Drawing Sheets

STORAGE BOX FOR ASSEMBLED TOYS

CROSS-REFERENCE TO RELATED APPLICATIONS

The application claims priority of Chinese patent application CN2025224180029, filed on Nov. 14, 2025, which is incorporated herein by reference in its entirety.

TECHNICAL FIELD

The present disclosure relates to the field of storage box, particularly to a storage box for assembled toys.

BACKGROUND ART

As is known, a storage box is used to collect items in a centralized manner. At present, the existing storage box is limited to a single storage function, failing to meet other needs of users, especially when it is used for assembled toys' storage. During the process of assembling the assembled toys into a specific assembly pattern, the user needs to repeatedly pick up the box for assembled toys to view the assembly pattern, reducing the efficiency of assembling the toy.

Therefore, there is an urgent need in the market to provide a storage box for assembled toys capable of supporting the box for assembled toys to display an assembly pattern.

SUMMARY

In order to overcome the shortcomings of the prior art, the present disclosure provides a storage box for assembled toys enabling a user to put away assembled toys and to tilt and place the box for assembled toys to display an assembly pattern.

The technical solution adopted by the present disclosure to solve the technical problem is:

The present disclosure provides a storage box for assembled toys including a housing, a box cover and a supporting structure.

The housing defines a first accommodating groove for accommodating assembled toys. The box cover covers the housing. The box cover includes a first plate and a first side plate provided on the first plate. The first side plate defines a limiting slot for avoiding the box for assembled toys.

The supporting structure is arranged on the first plate and spaced apart from the first side plate. The supporting structure is provided with a supporting portion inclined to a horizontal plane. The supporting portion is arranged opposite to the limiting slot. The supporting portion is configured for abutting against a side wall of the box for assembled toys to tilt and place the box for assembled toys.

The present disclosure has the following beneficial effects. The assembled toys are stored neatly in the first accommodating groove of the housing, preventing the assembled toys from being scattered and causing a clutter problem. The box cover covers the housing to protect the assembled toys inside, playing a dust-proof role. The side wall of the box for assembled toys can placed on the supporting portion to tilt the box for assembled toys 8. The limiting slot accommodates part of the box for assembled toys. At the same time, a bottom portion of the limiting slot abuts against the box for assembled toys, and the box for assembled toys is placed on the supporting portion, so that the box for assembled toys is obliquely supported. Consequently, the box for assembled toys does not fall down, to display the assembly pattern of the assembled toys on the box for assembled toys, facilitating a user to view the assembly pattern and assemble the assembled toys. Therefore, the assembly efficiency is improved, the functionality of the storage box for assembled toys is increased, and the practicability of the storage box is also enhanced.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
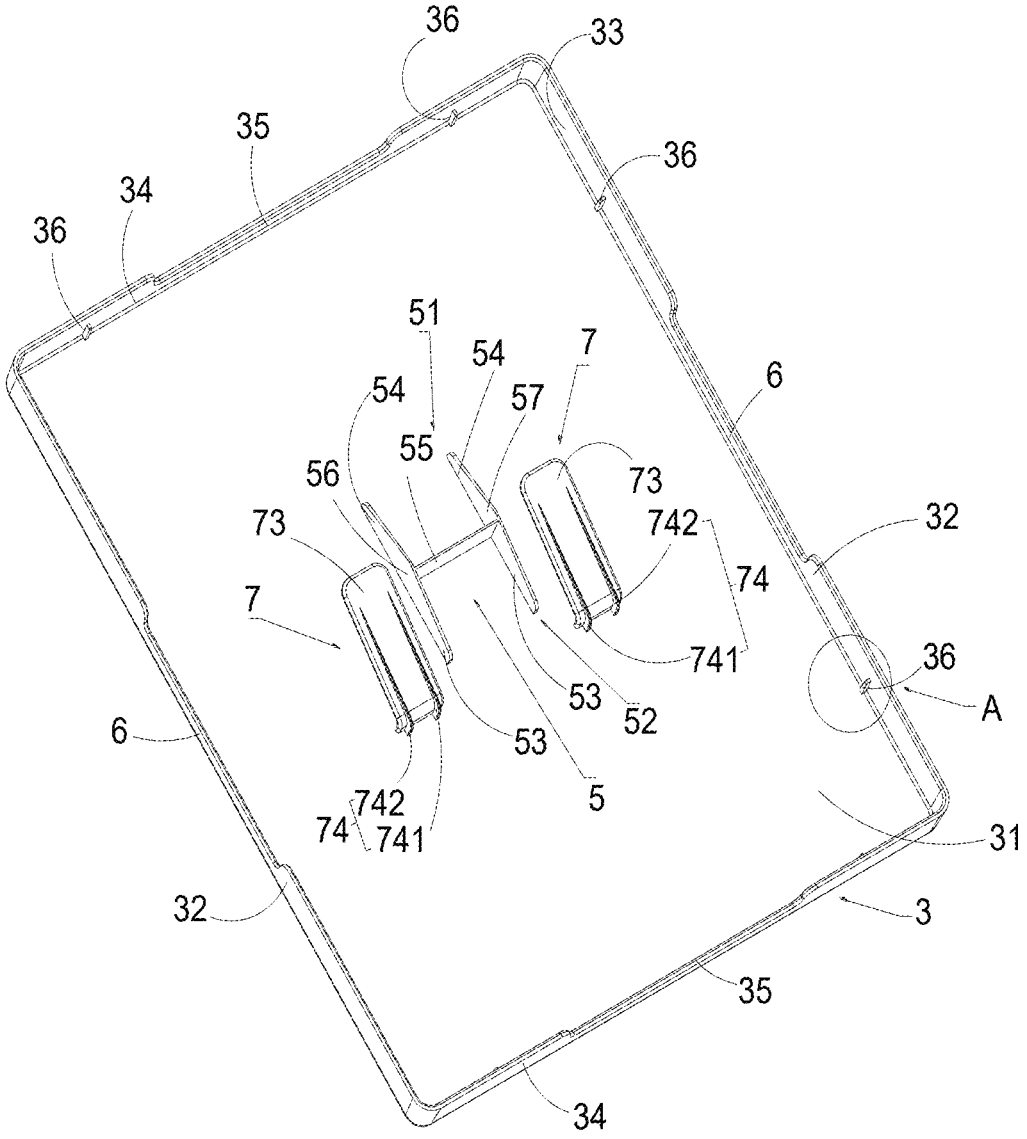
FIG. 1 is a structural schematic diagram of a box cover of the present disclosure.
Figure 2:
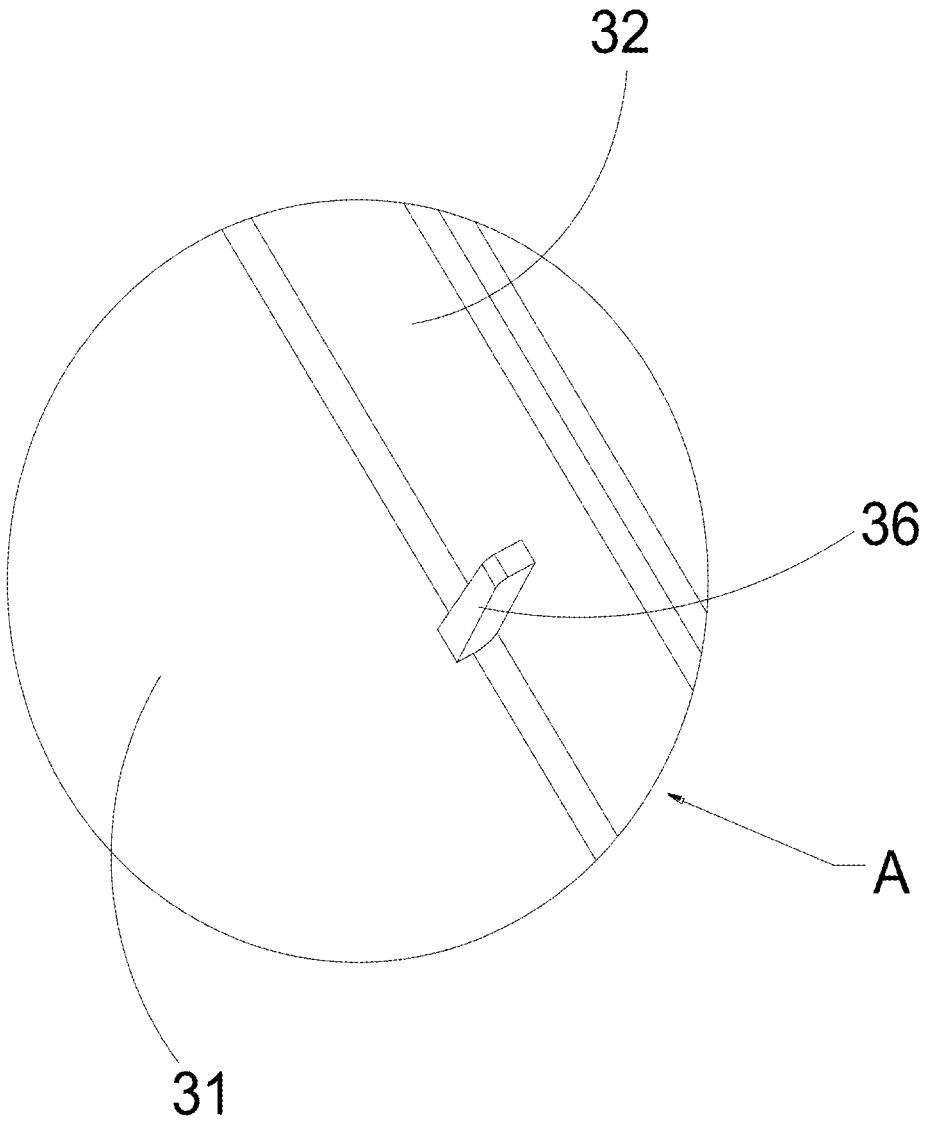
FIG. 2 is an enlarged view at a structure of portion A in FIG. 1.
Figure 3:
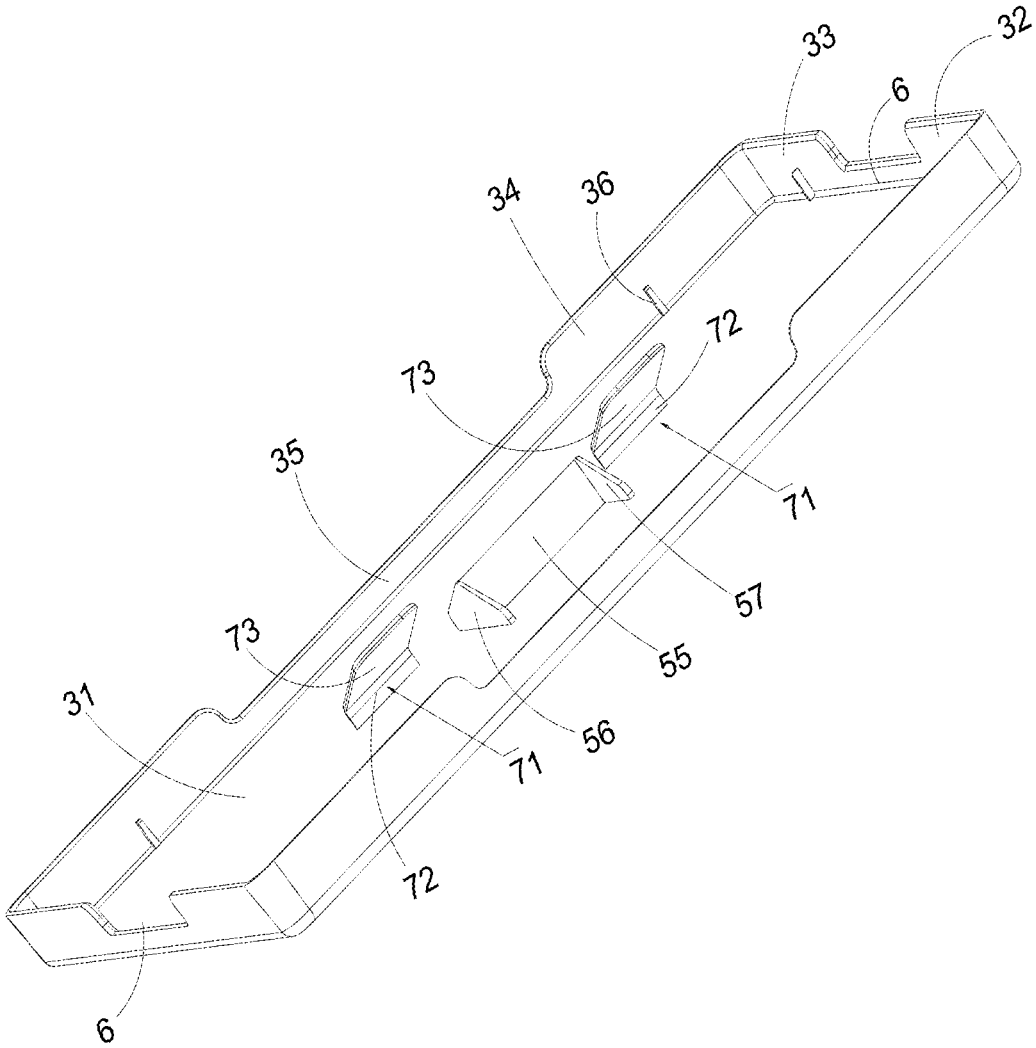
FIG. 3 is a structural schematic diagram of the box cover of the present disclosure from a first perspective view.
Figure 4:
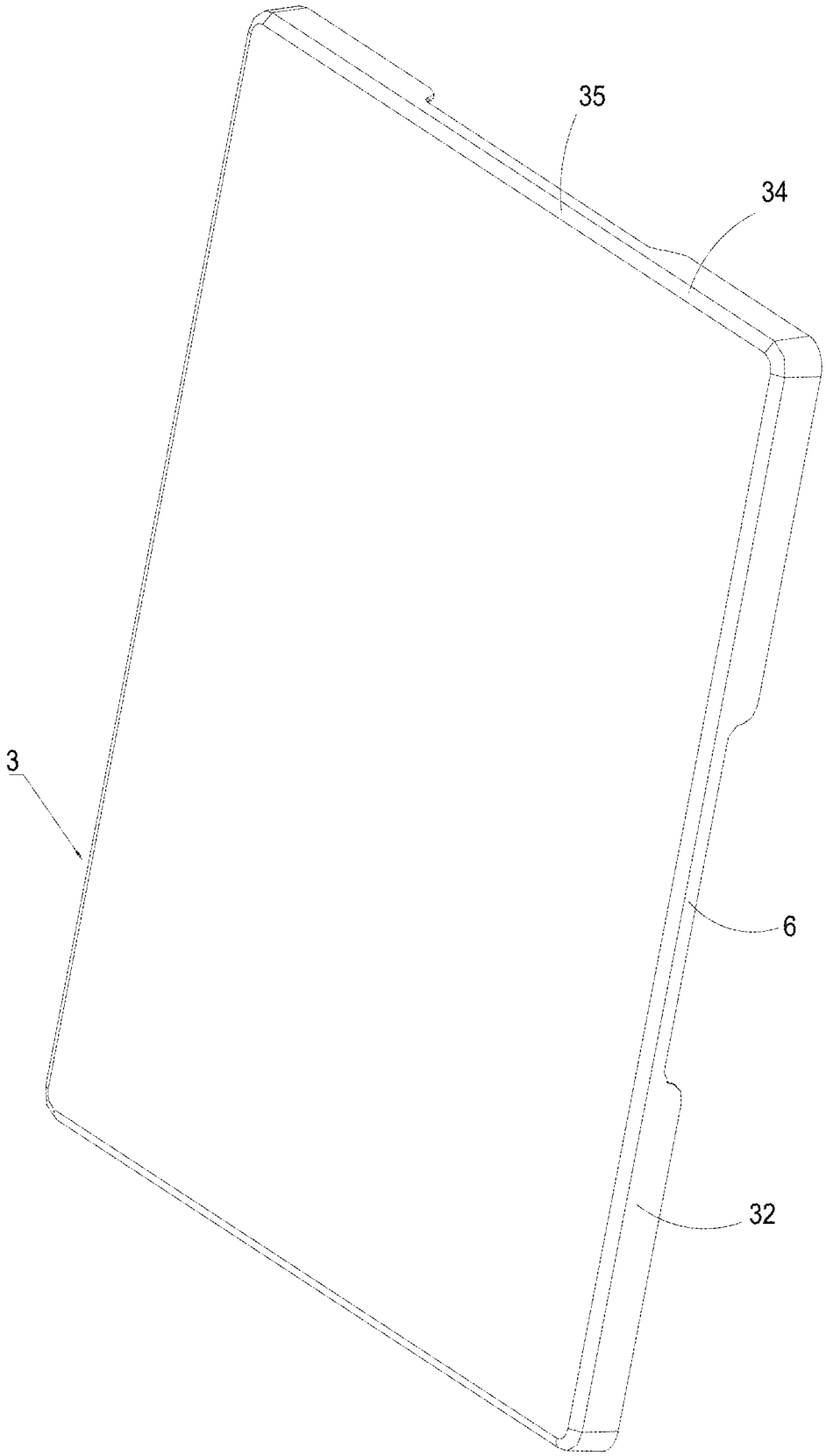
FIG. 4 is a structural schematic diagram of the box cover of the present disclosure from a second perspective view.
Figure 5:
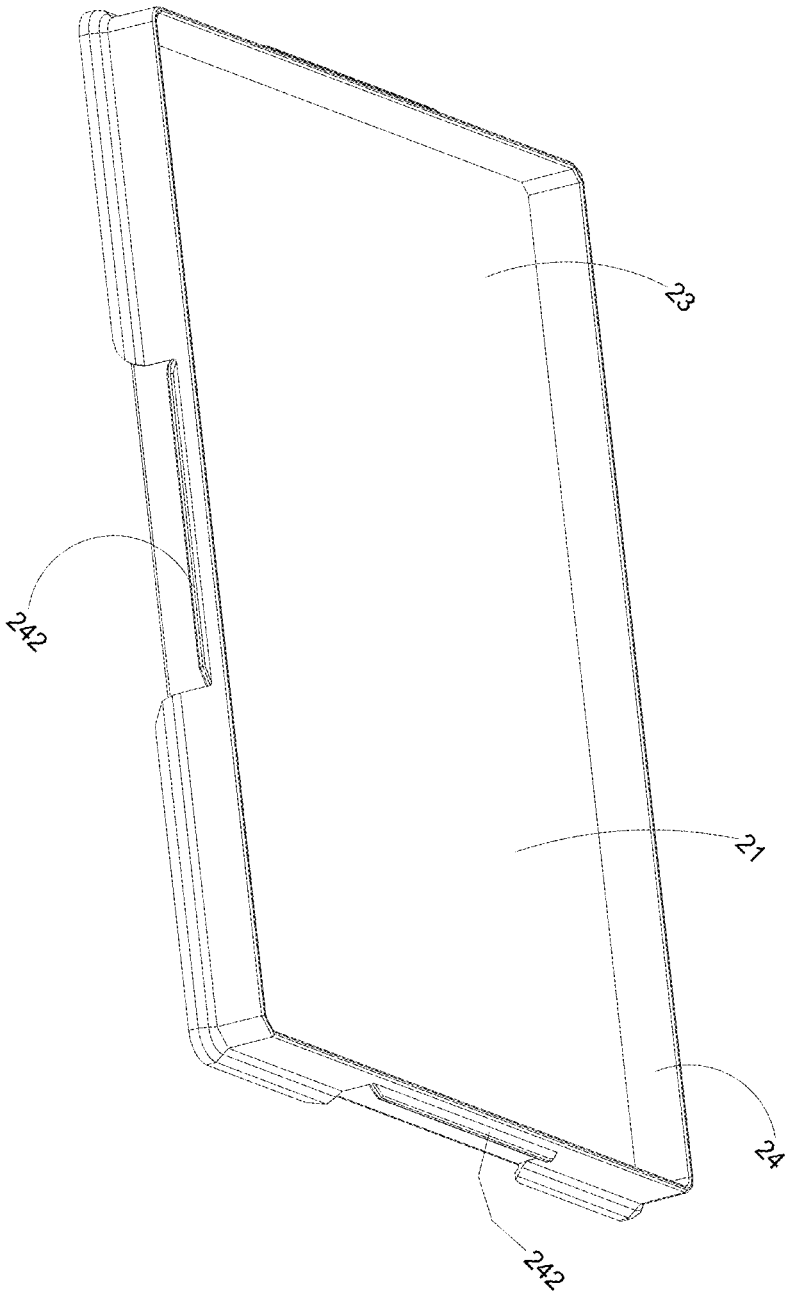
FIG. 5 is a structural schematic diagram of a housing of the present disclosure.
Figure 6:
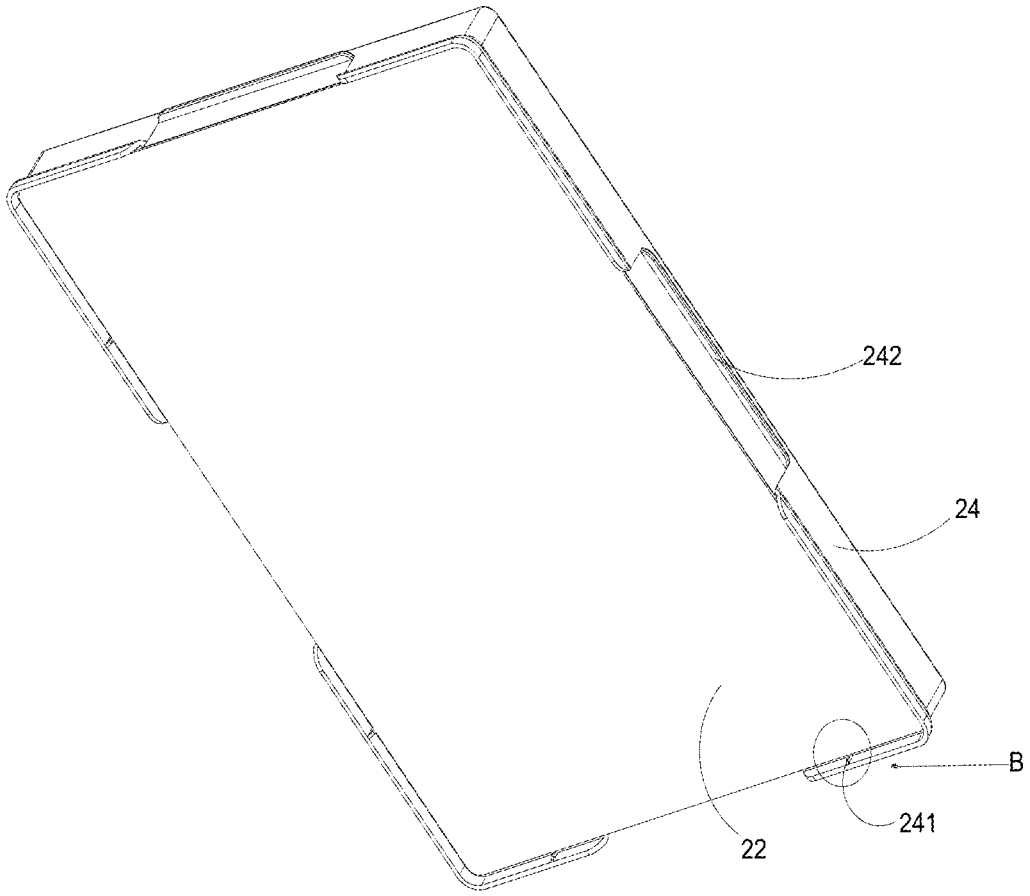
FIG. 6 is a structural schematic diagram of the housing of the present disclosure from another perspective view.
Figure 7:
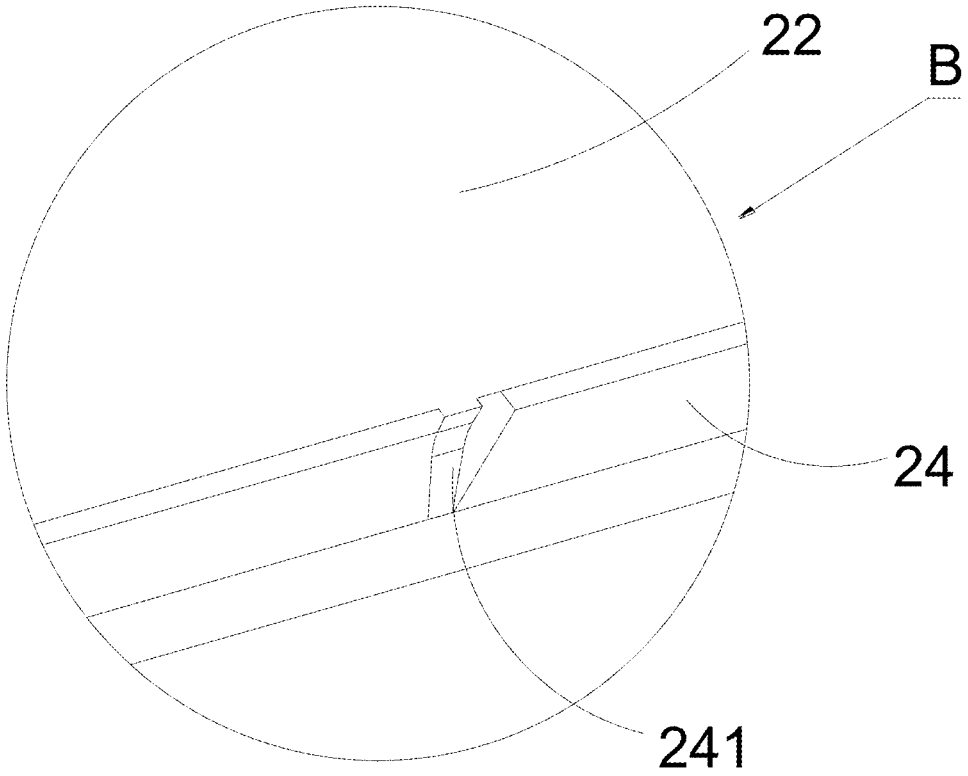
FIG. 7 is an enlarged view at a structure of portion B in FIG. 6.
Figure 8:
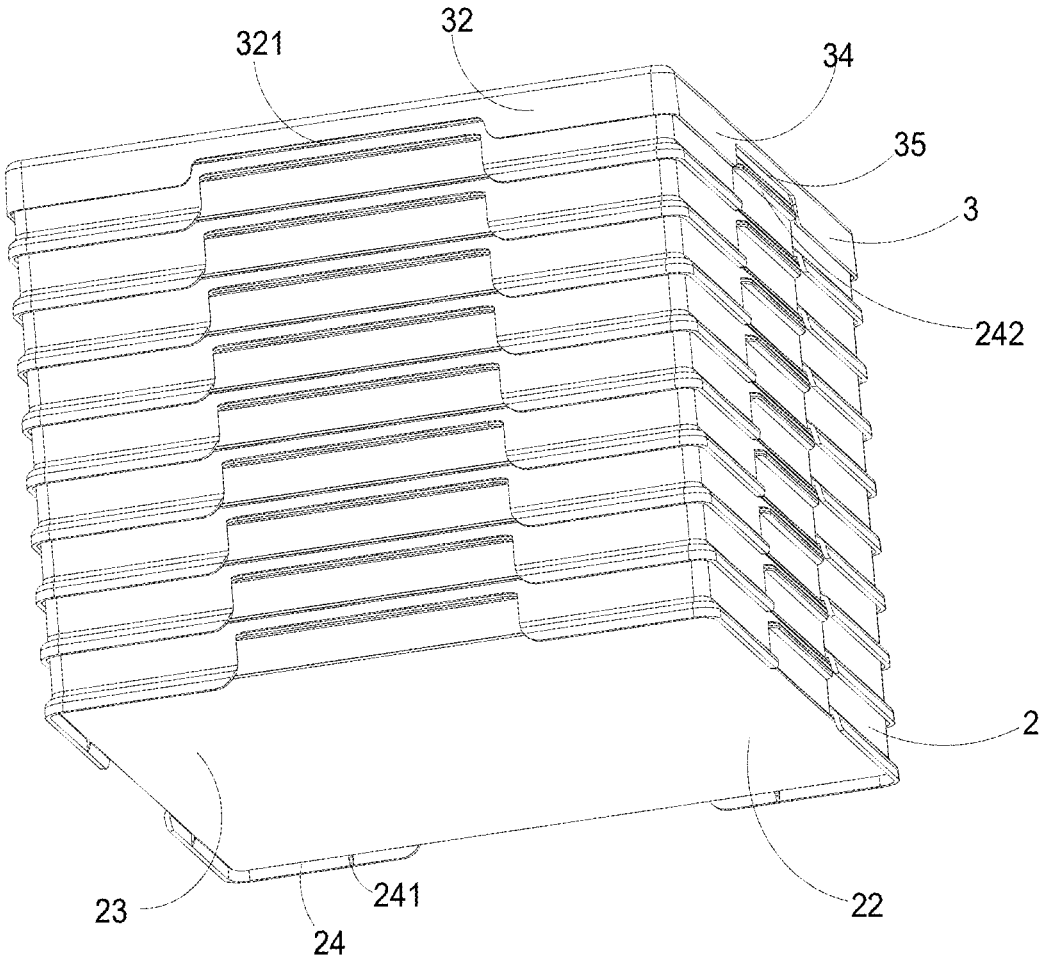
FIG. 8 is a schematic diagram of the present disclosure in a stacking state.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Referring to FIG. 1 to FIG. 7, a storage box for assembled toys 1 provided by the present embodiment includes a housing 2, a box cover 3 covering the housing 2, and a supporting structure 5. The housing 2 defines a first accommodating groove 21 for accommodating assembled toys. The box cover 3 includes a first plate 31 and a first side plate 32 provided on the first plate 31. The first side plate 32 defines a limiting slot 6 configured for avoiding a box for assembled toys 8. The supporting structure 5 is arranged on on the first plate 31 and spaced apart from the first side plate 32. The supporting structure 5 is provided with a supporting portion 51 inclined to a horizontal plane. The supporting portion 51 is arranged opposite to the limiting slot 6. The supporting portion 51 is configured for abutting against a side wall 81 of the box for assembled toys 8 so that the box for assembled toys 8 is obliquely placed.

The first accommodating groove 21 of the housing 2 is configured for accommodating the assembled toys neatly. The box cover 3 covers the housing 2 and the assembled toys to protect the assembled toys from dust. A side wall 81 of the box for assembled toys 8 can placed on the supporting portion 51 to tilt the box for assembled toys 8. The limiting slot 6 is configured for accommodating part of the box for assembled toys 8 to avoid the box for assembled toys 8. A bottom portion of the limiting slot 6 abuts against the box for assembled toys 8 to prevent the inclined box for assembled toys 8 from falling down, so as to display an assembly pattern 82 of the assembled toys. So that a user can conveniently view the assembly pattern 82 on the box for assembled toys 8 and assemble the assembled toys, thereby improving the assembly efficiency. Through the structure above, the storage box can not only be used for the assembled toys' storage, but can also be obliquely supported. The functionality of the storage box for assembled toys is increased, and the practicability of the storage box for assembled toys is enhanced.

Specifically, the assembled toys may be puzzles, building blocks, magnetic sheets, or the like.

In the present embodiment, a total number of the supporting portions 51 is two, and they are respectively a first inclined portion 53 and a second inclined portion 54. The first inclined portion 53 and the second inclined portion 54 are both arranged opposite to the limiting slot 6. The first inclined portion 53 is positioned on one side of the second inclined portion 54. A first end of the first inclined portion 53 is arranged adjacent to a first end of the second inclined portion 54. A second end of the first inclined portion 53 extends in a direction away from the second inclined portion 54 and is inclined toward the first plate 31. A second end of the second inclined portion 54 extends in a direction away from the first inclined portion 53 and is inclined toward the first plate, that is, the first inclined portion 53 and the second inclined portion 54 are inclined in reverse directions.

Through the above structure, when the user needs to support and tilt the box for assembled toys 8, the user places the side wall 81 of the box for assembled toys 8 on the first inclined portion 53 or the second inclined portion 54, and the side wall 81 of the box for assembled toys 8 is placed in the limiting slot 6, so that the box for assembled toys 8 is inclined. Moreover, the limiting slot 6 is configured for accommodating part of the box for assembled toys 8 to avoid the box for assembled toys 8. The bottom portion of the limiting slot 6 abuts against the box for assembled toys 8, preventing the obliquely placed box for assembled toys 8 from falling down. The first inclined portion 53 and the second inclined portion 54 inclined in the reverse directions can both cooperate with the bottom portion of the limiting slot 6 to obliquely support the box for assembled toys 8. When the user takes the box cover down and needs to assemble the toy, one of the supporting portions 51 can be found quickly to cooperate with the bottom portion of the limiting slot 6 to obliquely support the box for assembled toys 8, which is convenient for the user to use.

In the present embodiment, the supporting structure 5 includes a connecting plate 55, and a first supporting plate 56 and a second supporting plate 57 arranged at intervals. The first supporting plate 56 and the second supporting plate 57 are connected via the connecting plate 55. The first supporting plate 56 and the second supporting plate 57 both include the first inclined portion 53 and the second inclined portion 54. The first inclined portion 53 and the second inclined portion 54 are positioned on two sides of the connecting plate 55. The first supporting plate 56, the second supporting plate 57, and the connecting plate are both plate-shaped, and the plates can effectively save material of the supporting structure 5 while the plates form the first inclined portion 53 and the second inclined portion 54. Adopting the connecting plate 55 improves the strength of the supporting structure 5, so that the structure is more stable. A support force can be jointly borne by the first supporting plate 56, the second supporting plate 57 and the connecting plate 55, thereby prolonging the service life of the first supporting plate 56 and the second supporting plate 57. The first supporting plate 56 and second supporting plate 57 are shaped with two inclined sides, which includes but is not limited to a triangular profile. In other embodiments, the supporting structure 5 can also be a four-sided frustum with bevels on both sides, instead of being composed of a first supporting plate 56, a second supporting plate 57, and a connecting plate 55.

Figure 9:
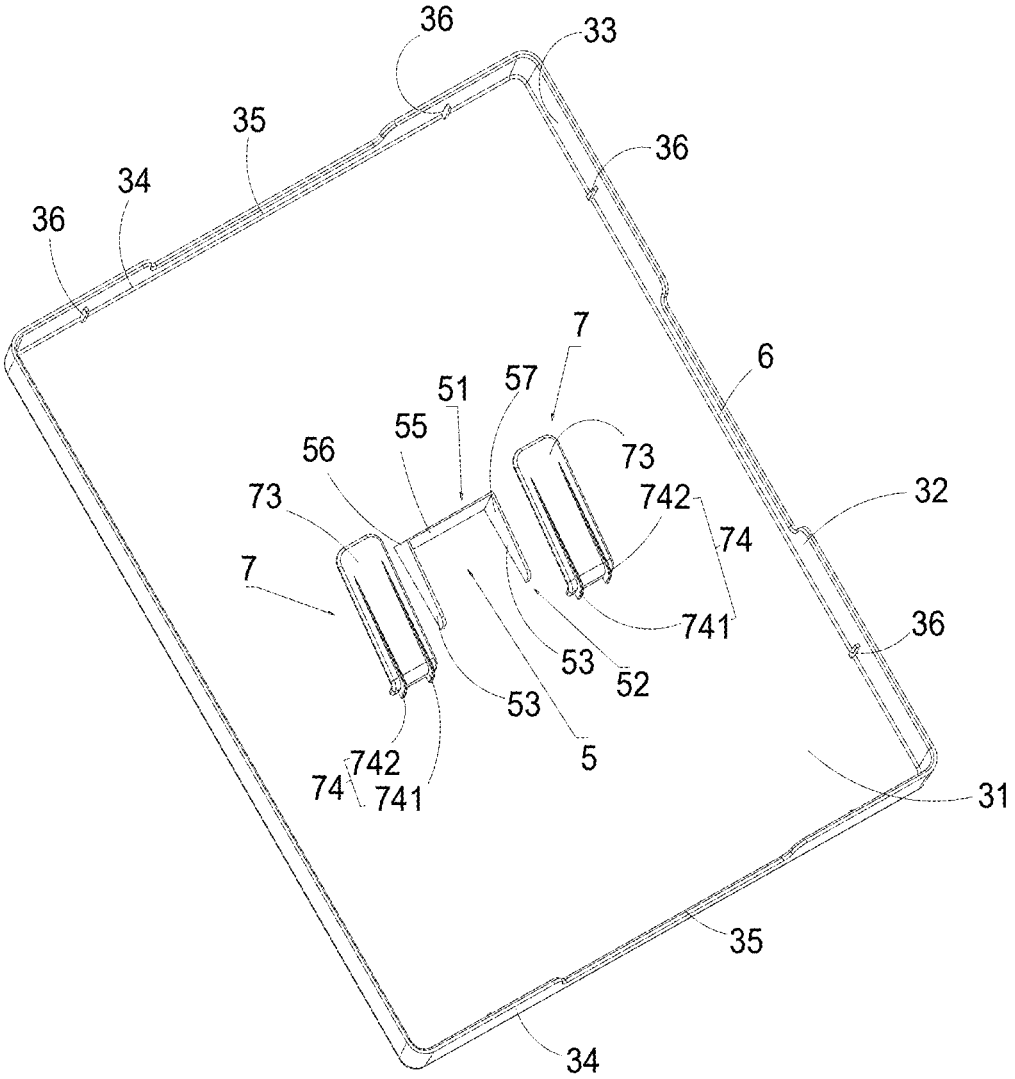
FIG. 9 is a schematic diagram according to another embodiment of the present disclosure configured with a limiting slot and a supporting portion.

Referring to FIG. 9, in other embodiments, the total number of the supporting portion 51 may also be one, that is, the user supports and displays the box for assembled toys 8 through the supporting portion 51. In this embodiment, the supporting structure 5 can also be formed by the first supporting plate 56, the second supporting plate 57, and the connecting plate 55, and the first supporting plate 56 and the second supporting plate 57 are right-angled triangles, right-angled trapezoid, etc. Alternatively, the total number of the supporting portions 51 can also be three, four, etc. for example, the supporting structure 5 may also be a four-sided pyramid with three inclined sides or a four-sided pyramid with four inclined sides, among other configurations.

Referring to FIG. 9, in an embodiment, a total number of the limiting slot 6 can be one. The bottom portion of one limiting slot 6 abuts against the box for assembled toys 8, and in combination with the supporting portion 51, so that the box for assembled toys 8 can be obliquely placed. Moreover, the limiting slot 6 is configured for accommodating part of the box for assembled toys 8, so as to avoid the box for assembled toys 8.

Quite usefully, in an another embodiment, a total number of the first side plates 32 is two, and the two side plates 32 are positioned on two opposite sides of the first plate 31. The total number of the limiting slots 6 is two, and the two limiting slots 6 are respectively positioned on the two first side plates 32. By configuring the limiting slots 6 on both sides of the first plate 31 to abut against the box for assembled toys 8 from both sides of the supporting structure 5, and in combination with the supporting portion 51, more stable inclined placement of the box for assembled toys 8 can be realized. The limiting slot 6 is configured for accommodating part of the box for assembled toys 8 to avoid the box for assembled toys 8.

In an embodiment, the storage box for assembled toys further includes a clamping structure 7 provided on the first plate 31 and spaced apart from the supporting structure 5. A clamping gap 71 is formed between the clamping structure and the supporting structure 5. The clamping gap 71 is configured for clamping the side wall of the box for assembled toys 8.

Figure 11:
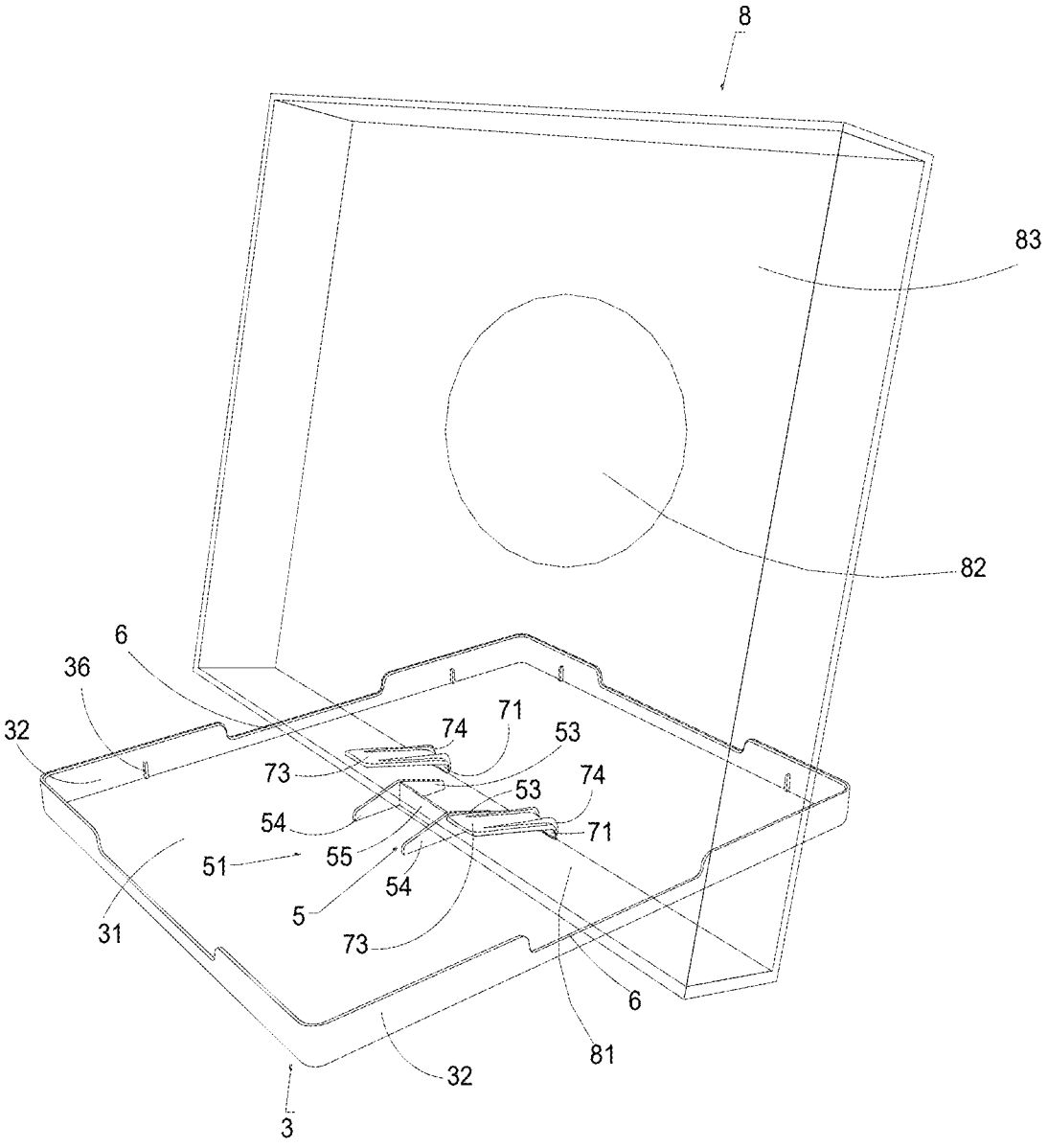
FIG. 11 is a schematic diagram of a transparent cover body supported by the box cover to be placed obliquely according to an embodiment of the present disclosure.

It should be noted that the box for assembled toys 8 is generally composed of a box body and a cover body 83 covering the box body. The cover body 83 is generally composed of a plate body and the side wall 81 provided around a periphery of the plate body. An outer surface of the plate body is printed with a combined state diagram of the assembled toys (i.e. the assembly pattern 82). When the box cover 3 of the present embodiment supports the inclined placement of the box for assembled toys 8, the side wall 81 on the cover body 83 can be inserted into the clamping gap 71, so that the cover body 83 is effectively limited, referring to FIG. 11. Therefore, the cover body 83 is not easy to fall down when the cover body 83 is placed obliquely, and the stability of the inclined placement is increased.

Specifically, in the present embodiment, the clamping structure 7 includes a blocking portion 72 and a clamping portion 73. A first end of the blocking portion 72 is connected to the first plate 31. A second end of the blocking portion 72 is connected to a first end of the clamping portion 73. The clamping gap 71 is formed by the clamping portion 73, the blocking portion 72 and the supporting portion 51. A distance between the clamping portion 73 and the first plate 31 gradually increases in a direction away from the blocking portion 72, that is, the clamping portion 73 is in an inclined state to adapt to the inclined supporting portion 51 for use, so as to clamp the side wall 81 of the cover body 83. When a height of the side wall 81 of the cover body 83 is greater than a length of the clamping portion 73, the blocking portion 72 can prevent the cover body 83 from continuing to move along the inclined direction of the supporting portion 51, so as to limit a position of the cover body 83 and increase the clamping stability of the clamping structure 7.

In the present embodiment, a total number of the clamping structures 7 is two. The two clamping structures 7 are positioned on two sides of the supporting structure 5. Through the above structure, a width of the clamping structure 7 can be increased, so as to increase a contact area between the clamping structure 7 and the side wall 81 of the cover body 83, better limiting the cover body 83. So that the cover body 83 will not easily fall out during the clamping process, further improving the stability of the inclined placement of the cover body 83. In other embodiments, the total number of the clamping structures 7 can also be one, three, etc. The clamping structure 7 and the supporting structure 5 are opposite in position.

In the present embodiment, the clamping structure 7 is provided with a reinforcing rib 74 for increasing strength of the clamping structure 7. One end of the reinforcing rib 74 is connected to the first plate 31. Through the above structure, a range of a size of the clamping gap 71 can be reduced to improve the limiting effect and the clamping strength of the clamping gap 71, so that the clamping structure 7 is not easily broken, and the service life of the clamping structure 7 is prolonged.

Specifically, in the present embodiment, the reinforcing rib 74 includes a first protruding strip 741 connected to the first plate 31 and a second protruding strip 742 connected to the first protruding strip 741. The first protruding strip 741 is connected to a first side of the clamping portion 73 adjacent to the supporting structure 5. The second protruding strip 742 is connected to a second side of the clamping portion 73 away from the supporting structure 5. A width of the second protruding strip 742 gradually decreases in a direction away from the first protruding strip 741, so that the clamping portion 73 possesses a stronger elastic deformation force at a position away from the blocking portion 72, thus, the side wall 81 of the cover body 83 can be quickly inserted into the clamping gap 71, and the strength of the clamping structure can be effectively improved.

In the present embodiment, a total number of the reinforcing ribs 74 is two. The two reinforcing ribs 74 are arranged at intervals to enhance the strength of the clamping structure 7, so that the clamping structure 7 is not easily damaged.

In the present embodiment, the box cover 3, the supporting structure 5 and the clamping structure 7 are integrally formed, thereby simplifying the production process and facilitating the production of the box for assembled toys 8.

In another embodiment, the supporting structure 5 and the clamping structure 7 can be fixed on the box cover 3 in a later stage by ultrasonic welding, pasting and the like.

In another embodiment, the clamping structure 7 can further includes only the clamping portion 73, that is, a first end of the clamping portion 73 is directly connected to the first plate 31, and a distance between a second end of the clamping portion 73 and the first plate 31 gradually increases in a direction away from the first end of the clamping portion 73, and the clamping gap 71 can also be formed between the clamping portion 73 and the supporting portion 5.

Referring to FIG. 5 to FIG. 8, in this embodiment, a bottom portion of the housing 2 defines a second accommodating groove 22. The second accommodating groove 22 of the housing 2 is configured for fitting with a top portion of another housing 2, so that the two housings 2 can be stacked in a height direction. The second accommodating groove 22 is capable of accommodating the top portion of another housing 2, that is, the two identical housings 2 can fit with and cover each other, so that the plurality of housings 2 are stacked, and horizontal movement is avoided when the two housings are stacked. In addition, when the plurality of housings 2 are stacked, the storage box for assembled toys in the present embodiment can be used for a plurality of assembled toys' storage and classification at the same time. That facilitates the user to use, and avoids a problem of the occupied space increasing due to using the plurality of storage boxes for assembled toys.

In the present embodiment, the housing 2 includes a second plate 23, a first surrounding wall 33 connected to the second plate 23 to form the first accommodating groove 21, and a second surrounding wall 24 connected to the second plate 23 to form the second accommodating groove 22.

When the two housings 2 are stacked, at least part of the first surrounding wall 33 of the lower housing 2 is placed in the second accommodating groove 22 of the upper housing 2. Through the above structure, the first accommodating groove 21 and the second accommodating groove 22 are formed to enable the two housings 2 to be stacked.

In this embodiment, the second surrounding wall 24 protrudes to form a plurality of first reinforcing protrusions 241 to increase strength of the second surrounding wall 24.

In the present embodiment, both sides of the first surrounding wall 33 protrude outwards to form handle protrusions 242. Through the above structure, when the plurality of housings 2 are stacked, the user can lift the housing 2 via the handle protrusion, so that the two housings are quickly separated, thereby facilitating use. In other embodiments, four sides of the first surrounding wall 33 protrude outwards to form the handle protrusions 242. Or, an outer side of the first surrounding wall 33 is recessed inwards to form a groove, also enabling the user to lift the housing 2.

In the present embodiment, the box cover 3 further includes two second side plates 34 connected to the first side plate 32 and the first plate 31. The two second side plates 34 are arranged opposite to each other. The second side plate 34 defines an avoidance opening 35 for avoiding the handle protrusion 242, so that when the housing 2 is stacked, the avoidance opening 35 guides the user directly to the handle protrusion 242, thereby accelerating the separation of the plurality of stacked housings 2, and preventing the handle protrusion 242 from interfering with the box cover 3. The structural design is reasonable.

Further, the first side plate 32 and the second side plate 34 are each provided with a second reinforcing protrusion 36 for increasing strength. The second reinforcing protrusion 36 is connected to the first plate 31 to improve the structural strength of the box cover 3.

A height of the second reinforcing protrusion 36 is less than a height of the first side plate 32. The second reinforcing protrusion 36 is positioned above the housing 2 when the box cover 3 covers the housing 2. When the box cover 3 covers the housing 2, a space is provided to the supporting structure 5 and the clamping structure 7 by arranging the second reinforcing protrusion 36, so as to prevent the supporting structure 5 and the clamping structure 7 from excessively occupying first accommodating groove 21, thereby affecting the storage space of the assembled toys.

In the present embodiment, the second surrounding wall 24 is at least partially arc-shaped, such that the first surrounding wall 33 does not have a sharp edge angle, protecting the user from being scratched.

The second surrounding wall 24 at least partially protrudes outwards. A size of the cross section of the second accommodating groove 22 is greater than a size of the cross section of the first accommodating groove 21, allowing the first surrounding wall 33 to be placed in the second accommodating groove of another housing to stack the plurality of housings. In other embodiments, the size of the cross section of the second accommodating groove 22 can also be equal to or slightly smaller than a size of a bottom surface of the first accommodating groove 21, that is, a length and a width of the first surrounding wall 33 gradually decrease in a direction away from the second accommodating groove 22. So that an area of a top end of the first surrounding wall 33 is smaller than an opening of the second accommodating groove 22, therefore the first surrounding wall 33 can be placed in the second accommodating groove 22.

Figure 10:
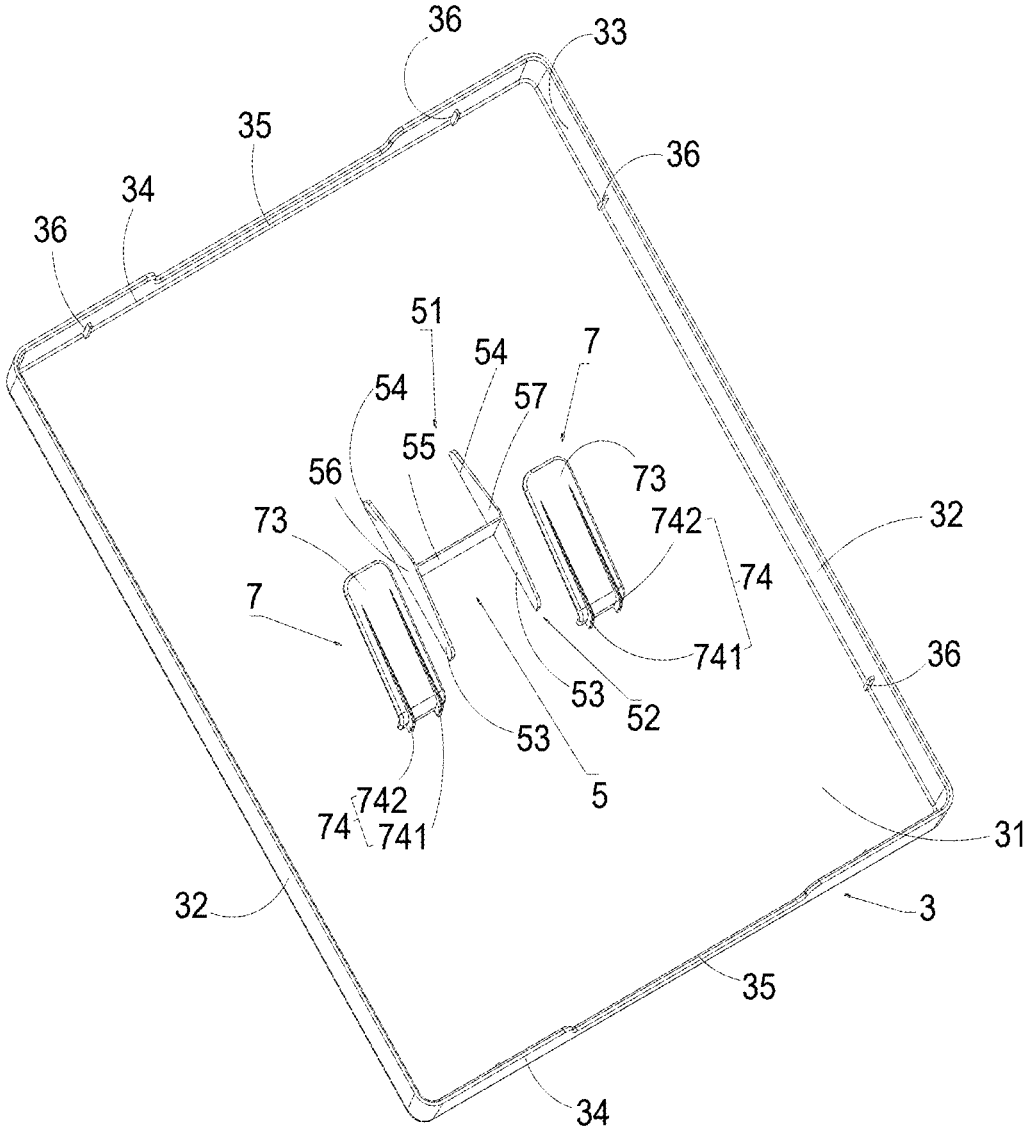
FIG. 10 is a schematic diagram according to another embodiment of the present disclosure not defining the limiting slot.

Referring to FIG. 10, in another embodiment, the storage box for assembled toys 1 does not include the limiting slot 6, that is, the box cover 3 includes a supporting structure 5 and a clamping structure 7. The clamping structure 7 is matched with the supporting structure 5 to form a clamping gap 71. Through the clamping gap 71 limiting the side wall 81 of the cover body 83, the cover body 83 can also be obliquely or vertically supported to display the assembly pattern on the box for assembled toys 8.

Specifically, in the present embodiment, the storage box for assembled toys 1 includes the housing 2, the box cover 3, the supporting structure 5, and the clamping structure 7. The box cover 3 that can cover the housing 2. The housing 2 defines the first accommodating groove 21 for accommodating the assembled toys. The box cover 3 includes a first plate 31 and a first side plate 32 arranged on the first plate 31. The supporting structure 5 is provided on the first plate 31 and spaced apart from the first side plate 32. The supporting structure 5 is provided with a supporting portion 51. The supporting portion 51 can be parallel or inclined to the horizontal plane. The clamping structure 7 is provided on the first plate 31 and is spaced apart from the supporting structure 5, and a clamping gap 71 is formed between the supporting structure 5 and the supporting structure 5, so as to obliquely or vertically support the cover body 83.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

The invention claimed is:

1. A storage box for assembled toys, comprising:

a housing, the housing defining a first accommodating groove for accommodating assembled toys;

a box cover, the box cover covering on the housing, the box cover comprising a first plate, and a first side plate provided on the first plate, the first side plate defining a limiting slot for avoiding an assembled toy box;

a supporting structure, wherein the supporting structure is arranged on the first plate and spaced apart from the first side plate, the supporting structure is provided with a supporting portion inclined to the horizontal plane, the supporting portion is arranged opposite to the limiting slot, and the supporting portion is configured for abutting against a side wall of the assembled toy box so that the assembled toy box is obliquely placed;

wherein a total number of the supporting portions is two, and the two supporting portions are respectively a first inclined portion and a second inclined portion;

the first inclined portion and the second inclined portion are both arranged opposite to the limiting slot, the first inclined portion is positioned on one side of the second inclined portion, a first end of the first inclined portion is arranged adjacent to a first end of the second inclined portion, a second end of the first inclined portion extends in a direction away from the second inclined portion and is inclined towards the first plate, and a second end of the second inclined portion extends in a direction away from the first inclined portion and is inclined towards the first plate.

2. The storage box according to claim 1, wherein a total number of the supporting portion is one.

3. The storage box according to claim 1, wherein the supporting structure comprises a connecting plate, and a first supporting plate and a second supporting plate arranged at intervals, the first supporting plate and the second supporting plate are connected through the connecting plate, the first supporting plate and the second supporting plate both comprise the first inclined portion and the second inclined portion, and the first inclined portion and the second inclined portion are positioned on two sides of the connecting plate.

4. The storage box according to claim 1, wherein a total number of the limiting slot is one.

5. The storage box according to claim 1, further comprising a clamping structure, wherein the clamping structure is arranged on the first plate and spaced apart from the supporting structure, a clamping gap is formed between the supporting structure and the clamping structure, and the clamping gap is configured for clamping and limiting a side wall of the assembled toy box.

6. The storage box according to claim 5, wherein the box cover, the supporting structure and the clamping structure are integrally formed.

7. The storage box according to claim 1, wherein a bottom portion of the housing defines a second accommodating groove;

the second accommodating groove of the housing is configured for fitting with a top portion of another housing to stack the two housings in a height direction.

8. A storage box for assembled toys, comprising:

a housing, the housing defining a first accommodating groove for accommodating assembled toys;

a box cover, the box cover covering on the housing, the box cover comprising a first plate, and a first side plate provided on the first plate, the first side plate defining a limiting slot for avoiding an assembled toy box;

a supporting structure, wherein the supporting structure is arranged on the first plate and spaced apart from the first side plate, the supporting structure is provided with a supporting portion inclined to the horizontal plane, the supporting portion is arranged opposite to the limiting slot, and the supporting portion is configured for abutting against a side wall of the assembled toy box so that the assembled toy box is obliquely placed;

wherein a total number of the first side plates is two, and the two first side plates are positioned on two opposite sides of the first plate;

a total number of the limiting slots is two, and the two limiting slots are respectively positioned on the two first side plates.

9. A storage box for assembled toys, comprising:

a housing, the housing defining a first accommodating groove for accommodating assembled toys;

a box cover, the box cover covering on the housing, the box cover comprising a first plate, and a first side plate provided on the first plate, the first side plate defining a limiting slot for avoiding an assembled toy box;

a supporting structure, wherein the supporting structure is arranged on the first plate and spaced apart from the first side plate, the supporting structure is provided with a supporting portion inclined to the horizontal plane, the supporting portion is arranged opposite to the limiting slot, and the supporting portion is configured for abutting against a side wall of the assembled toy box so that the assembled toy box is obliquely placed;

the storage box further comprising a clamping structure, wherein the clamping structure is arranged on the first plate and spaced apart from the supporting structure, a clamping gap is formed between the supporting structure and the clamping structure, and the clamping gap is configured for clamping and limiting a side wall of the assembled toy box;

wherein the clamping structure comprises a blocking portion and a clamping portion, a first end of the blocking portion is connected to the first plate, a second end of the blocking portion is connected to a first end of the clamping portion, a distance between the clamping portion and the first plate gradually increases in a direction away from the blocking portion, the clamping portion, the blocking portion and the supporting portion surround to form the clamping gap.

10. The storage box according to claim 9, wherein a total number of the clamping structures is two, and the two clamping structures are positioned on two sides of the supporting structure.

11. The storage box according to claim 9, wherein the clamping structure is provided with a reinforcing rib for strengthening the clamping structure, and one end of the reinforcing rib is connected to the first plate.

12. The storage box according to claim 11, wherein the reinforcing rib comprises a first protruding strip connected to the first plate, and a second protruding strip connected to the first protruding strip, the first protruding strip is connected to a first side of the clamping portion adjacent to the supporting structure, the second protruding strip is connected to a second side of the clamping portion away from the supporting structure, and a width of the second protruding strip gradually decreases in a direction away from the first protruding strip.

13. The storage box according to claim 12, wherein a total number of the reinforcing ribs is two, and the two reinforcing ribs are arranged at intervals.

14. A storage box for assembled toys, comprising:

a housing, the housing defining a first accommodating groove for accommodating assembled toys;

a box cover, the box cover covering on the housing, the box cover comprising a first plate, and a first side plate provided on the first plate, the first side plate defining a limiting slot for avoiding an assembled toy box;

a supporting structure, wherein the supporting structure is arranged on the first plate and spaced apart from the first side plate, the supporting structure is provided with a supporting portion inclined to the horizontal plane, the supporting portion is arranged opposite to the limiting slot, and the supporting portion is configured for abutting against a side wall of the assembled toy box so that the assembled toy box is obliquely placed;

wherein a bottom portion of the housing defines a second accommodating groove;

the second accommodating groove of the housing is configured for fitting with a top portion of another housing to stack the two housings in a height direction;

wherein the housing comprises a second plate, a first surrounding wall connected to the second plate to form the first accommodating groove, and a second surrounding wall connected to the second plate to form the second accommodating groove;

when the two housings are stacked, at least part of the first surrounding wall of the lower housing is placed in the second accommodating groove of the upper housing.

15. The storage box according to claim 14, wherein the second surrounding wall protrudes to form a plurality of first reinforcing protrusions.

16. The storage box according to claim 14, wherein both sides of the first surrounding wall protrude outwards to form a handle protrusion.

17. The storage box according to claim 16, wherein the box cover further comprises a second side plate connected to the first side plate and the first plate; a total number of the second side plates is two, and the two second side plates are arranged opposite to each other;

the second side plate defines an avoidance opening for avoiding the handle protrusion;

the first side plate and the second side plate are each provided with a second reinforcing protrusion for increasing strength, the second reinforcing protrusion is connected to the first plate, a height of the second reinforcing protrusion is less than a height of the first side plate, and the second reinforcing protrusion is located above the housing when the box cover covers the housing.

18. The storage box according to claim 14, wherein the second surrounding wall at least partially protrudes outwards, the second surrounding wall is at least partially arc-shaped, and a size of a cross section of the second accommodating groove is greater than a size of a cross section of the first accommodating groove.

* * * * *